United States Patent [19]

Jones

[11] 4,130,161

[45] Dec. 19, 1978

[54] UNDERWATER CHRISTMAS TREE

[75] Inventor: Marvin R. Jones, Houston, Tex.

[73] Assignee: Cameron Iron Works, Inc., Houston, Tex.

[21] Appl. No.: 830,797

[22] Filed: Sep. 6, 1977

[51] Int. Cl.[2] ..... E21B 7/12

[52] U.S. Cl. ..... 166/337; 166/156; 166/363; 166/368

[58] Field of Search ..... 166/0.5, 0.6, 75 A, 166/75 R, 156; 137/268; 15/104.06 A, 104.06 B

[56] References Cited

U.S. PATENT DOCUMENTS

| | | | |
|---|---|---|---|
| 3,308,880 | 3/1967 | Yetman | 166/0.5 |
| 3,357,491 | 12/1967 | Jones et al. | 166/75 |
| 3,361,206 | 1/1968 | Raulins | 166/156 X |
| 3,396,789 | 8/1968 | Dean | 166/0.5 |
| 3,604,456 | 9/1971 | Jones | 137/594 |

*Primary Examiner*—Ernest R. Purser
*Assistant Examiner*—Richard E. Favreau

[57] ABSTRACT

An underwater Christmas tree for controlling flow from an offshore well is disclosed as having a master valve which is controlled by fluid pressure within a flow-line extending from a production bore of the tree, and means for receiving and releasably retaining a TFL tool in the production bore intermediate the location at which control pressure is sensed and the intersection of the production bore with an auxiliary bore of the tree through which wireline tools are run. Since the TFL tool limits flow therepast, flowline pressure may be maintained at a level necessary to maintain the master valve open independently of fluid pressure within the auxiliary bore.

7 Claims, 1 Drawing Figure

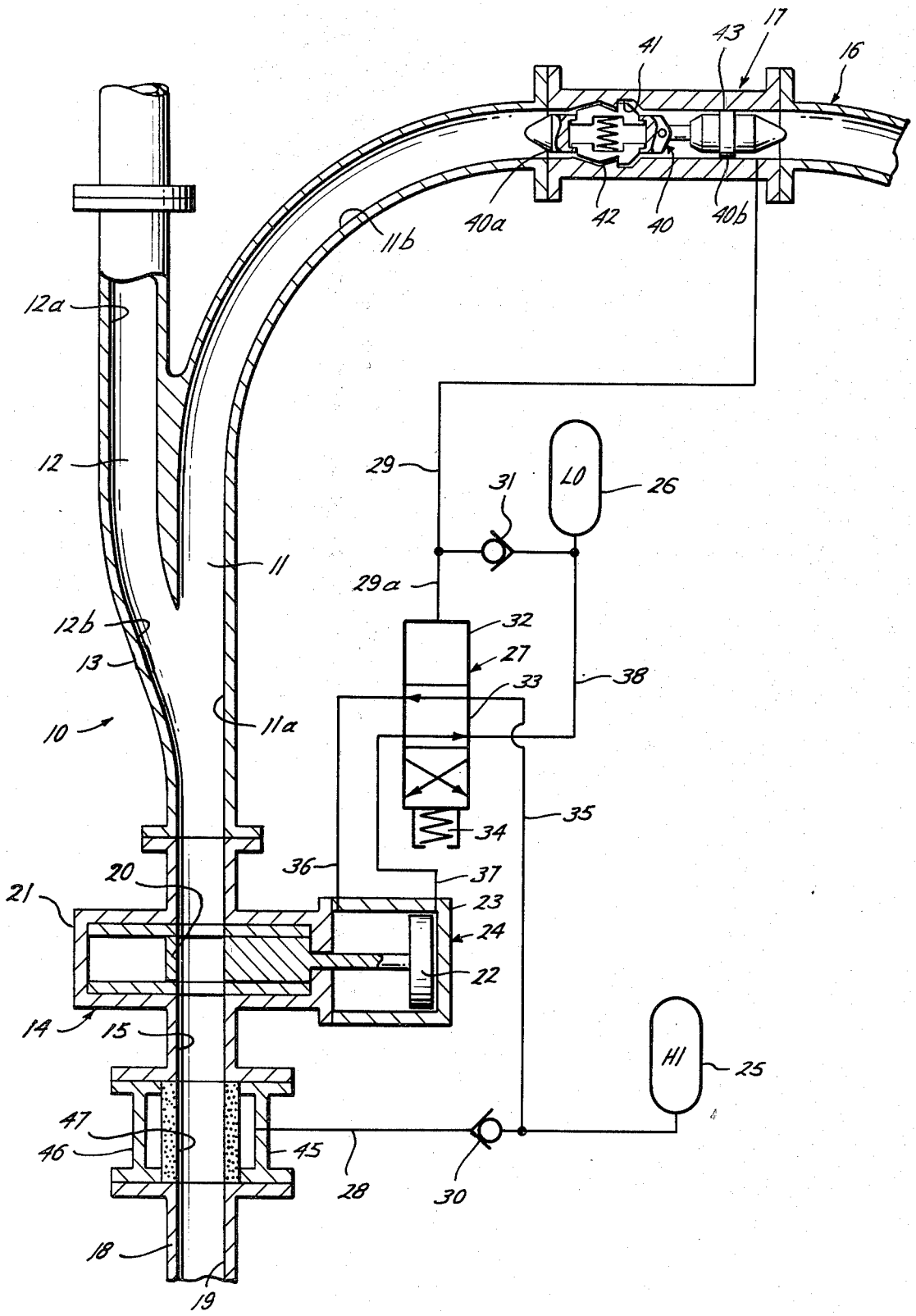
17
43
41
16
40a
42
40
40b
11b
12a
12
29
31
LO
26
11
29a
32
27
33
38
12b
13
10
11a
35
34
36
37
20
23
21
24
22
14
15
HI
25
47
46
45
28
30
18
19

UNDERWATER CHRISTMAS TREE

This invention relates in general to Christmas trees; and, more particularly, to improvements in underwater christmas trees used to control flow from an off-shore well.

As shown, for example, in U.S. Pat. No. 3,357,491, such trees have bores which permit both wire-line and TFL (through the flowline) tools to be lowered into and raised from the well. For this purpose, the tree has a production bore through which the TFL tools may be passed to and from the well through a flowline extending laterally from the tree, and an auxiliary bore intersecting the production bore through which wireline tools may be passed to and from the well through a riser pipe extending upwardly from the tree.

As shown in ASME Publication 71-PET-40, it has been proposed that the operator for the master valve of an underwater tree be controlled by a pilot valve which is responsive to the pressure of well fluid in the flowline. Thus, the pressure of the well fluid in the flowline may be raised above a predetermined value to open the master valve, and, conversely, permitted to fall below such value to close the master valve.

However, during running of the wireline tools, the sensed pressure may drop below the predetermined low value, thus causing the master valve to close on the wireline extending therethrough. To prevent this, it has been proposed to provide a separate pressure line for applying fluid from a remote high pressure source, such as on a workover rig, to the operator for the master valve in order to hold it open during all of the wireline operations. The installation and use of this supplementary control line necessarily increases the cost and complexities of the operation, and it is therefore an object of this invention to eliminate the necessity for the same, while at the same time maintaining remote control of the master valve.

More particularly, it is an object of this invention to provide an underwater Christmas tree having such a master valve which can be remotely opened by means of flowline pressure independently of the pressure in the portion of the Christmas tree through which the wireline tools are run.

These and other objects are accomplished, in accordance with the illustrated embodiment of this invention, by an underwater Christmas tree having means for receiving and releasably retaining a TFL tool within its production bore intermediate the intersection therewith of the auxiliary bore and the location in such bore, or in the flowline, at which flowline pressure is sensed for controlling the pilot valve of the master valve. When so received, the TFL tool limits flow therepast so that the fluid pressure at said location may be maintained above the predetermined value for maintaining the master valve open, regardless of the pressure within the portion of the tree through which a wireline is run. The TFL tool may be received and retained in a well known manner, such as by means of locking dogs which fit within grooves in the production bore or flowline.

The single FIGURE of the drawing is a diagrammatic sectional view of a Christmas tree installed on an offshore well and constructed in accordance with the present invention.

With reference now to the details of the drawing, the Christmas tree, which is indicated in its entirety by reference character 10, in similar in construction to that shown in the aforementioned U.S. Pat. No. 3,357,491, and the disclosure of such patent is therefore incorporated herein by reference. Thus, tree 10 has a production bore 11 which includes a lower generally vertical portion 11*a* and an upper portion 11*b* forming an upward continuation of lower portion 11*a* and curving upwardly and outwardly therefrom. The tree also includes an auxiliary bore 12 which includes a generally vertical upper portion 12*a* and a lower curved portion 12*b* which connects with production bore 11 near the intersection of its upper and lower portions 11*a* and 11*b*. Thus, auxiliary bore 12 forms an upward continuation of lower portion 11*a* of the production bore.

The tree includes a main body 13 having a lower end mounted on and connected to a master valve 14 to align the lower portion 11*a* of production bore 11 with a bore 15 through the master valve. The outer end of the upper portion 11*b* of the production bore is connected to a flowline 16 which, as well known in the art, extends laterally from the tree to a suitable facility on land or a platform for receiving the production fluid. For reasons to be described hereinafter, the outer end of production bore 11*b* which is connected to flowline 16 preferably comprises a tubular body 17 separate from main body 13. Upper portion 12*a* of the auxiliary bore extends through the main body for connection with a riser pipe which extends to the water level.

Master valve 14 is mounted on the head of the offshore well, which includes a production string 18 having a bore 19 aligned with the bore 15 of the master valve. A through-conduit gate 20 reciprocates within a body 21 of the master valve between the open position shown in the drawing and a closed position. With the master valve open, as shown, suitable wireline tools may be lowered into and raised from production bore portion 11*a*. Also, TFL tools may be pumped into and out of the production string through the flowline 16 and production bore 11. Gate 20 of the master valve is moved between opened and closed positions by an operator 24 which includes a piston 22 reciprocable within a cylinder 23 mounted on body 21.

As previously mentioned, piston 22 is reciprocated by means of well fluid without the need for a separate pressure line extending thereto from an independent pressure source. For this purpose, and as shown and described in more detail in U.S. Pat. No. 3,604,456, the control system for the master valve includes an accumulator 25 for storing well fluid at high pressure, and an accumulator 26 for storing well fluid at low pressure, both connected to a pilot valve 27 for connecting high and low pressure alternately with opposite sides of piston 22, and thus causing it to reciprocate for opening and closing the valve. Accumulator 25 receives high pressure fluid from the bore of the wellhead beneath the master valve by means of a conduit 28, while accumulator 26 exhausts to production bore 11 and flowline 16 through a conduit 29.

When master valve 14 is closed, accumulator 25 will be charged with the high pressure fluid beneath it, and this fluid is retained in accumulator 25, when the valve is opened, by means of a check valve 30 in conduit 28. When master valve 14 is closed, and the pressure in the tree thereabove, as well as within the flowline 16, drops to a low value, a check valve 31 in conduit 29 permits fluid pressure within accumulator 26 to assume a lower value. If need be, of course, suitable controls in the flowline may be manipulated to permit fluid pressure stored in accumulator 26 to assume an even lower value.

Pilot valve 27 includes a body 32 having a valving element 33 therein shiftable in response to control pressure which is introduced into the upper end of the body. The valving element is biased to an upper position, in opposition to control pressure, by means of a spring 34, so that control pressure at a predetermined level will maintian the valving element in the lower position shown, while a drop in the control pressure to a lesser value will permit the valving element to rise.

In its lower position, valving element connects a conduit 35 leading from accumulator 25 with a conduit 36 connecting with the rod end of piston 22 of the master valve operator, and connects a conduit 37 leading from the opposite side of piston 22 with a conduit 38 connecting with low pressure accumulator 26. Thus, with the valving element in this position, the high pressure fluid from accumulator 25 urges the piston to the right, while pressure fluid on the opposite side of the piston is exhausted into accumulator 26, so as to permit the piston and thus the gate 20 to shift to the right in order to open the master valve. As will be apparent, upon a drop in the control pressure which permits the valving element to shift upwardly to its alternate position, high pressure fluid is instead introduced to the opposite side of the piston, while pressure fluid on the rod side thereof is exhausted to permit the valve to move to closed position.

Pressure fluid for controlling pilot valve 27 is transmitted from the production bore and thus the flowline to the upper end of valving element 33 of the pilot valve by means of a conduit 29*a* leading from a conduit 29 intermediate check valve 31 and the connection of conduit 29 with the production bore. As described in the aforementioned ASME Publication, during normal production from the well, the pressure of the production fluid in the flowline is sufficiently high to maintain the pilot valve in the lower-most position, and thus maintain the master valve in open position. However, if flowline pressure should drop below the predetermined value, either accidentally or by manipulation, the pilot valve in caused to shift and thus move the master valve to closed position.

As previously described, the use of a wireline in running tools into and out of the well through the auxiliary bore may cause the fluid pressure within the tree, and thus within conduit 29, to drop to a level which would otherwise cause the pilot valve to shift to master valve closing position. In order to prevent this from occurring, this invention provides a means for receiving and retaining a TFL tool 40 within the production bore, and more particularly the portion thereof extending through tubular body 17, so as to close it off or at least limit the flow therepast. Thus, fluid pressure within the conduit 29 may be controlled by the fluid pressure within the flowline to the right of tool 40, and thus independently of fluid pressure in the remainder of the tree, including that portion through which the wireline tool in run. Consequently, flowline pressure can be manipulated so as to maintain control pressure at a value sufficiently high to maintain valving element 33 in the open position shown in the drawing.

For this purpose, the portion of production bore 11*b* within body 17 is provided with a locking groove 41 thereabout for receiving and retaining locking dogs 42 of the tool 40. As well known in the art, the locking dogs are free to move inwardly to a position which permits them to move through the flowline and the production bore, but are biased outwardly toward locking position so as to automatically fit within the groove when the tool reaches the position shown. As also known in the art, the dogs are preferably mounted on a forward portion 40*a* of the tool which is pivotally connected to a rearward portion 40*b* having a seal ring 43 disposed thereabout for engaging a sealing surface about the production bore of the flowline. Thus, with the tool in retained position, seal ring 43 closes off bore 11 to the left of the connection of sensing conduit 29 therewith.

The formation of groove 41 in the bore of the separate body 17 of the tree will of course facilitate its machining. As will also be understood, groove 41 is coded to receive the locking dogs of only the desired TFL tool 40, so that other TFL tools are permitted to move past the groove without interruption. TFL tool 40 may of course be removed from retained position within the production bore by first closing the master valve and then circulating through the production bore and toward the flowline.

Conduit 28 leading to high pressure accumulator 25 connects with the bore of a spool 46 which is connected between well string 18 and master valve 14 and thus forms part of the wellhead bore. A filter 47 is received within the spool in alignment with the bores through the well string and master valve so as to protect the conduit 28 from debris or particles within the production fluid. A similar filter may of course be installed in conduit 29.

In preparing to run a wireline tool into the well using the above-described apparatus, an operator may first kill the well, as well known in the art, by loading the production tubing with drilling mud circulating through a service tubing (not shown) and the production tubing, and reversely circulating the TFL tool 40 into its seat in the tree. While maintaining the reverse circulation pressure, the operator may then open the upper end of the riser extending above the auxiliary bore, and attach suitable wireline running equipment thereto. Alternatively, the operator may lower the flowline pressure until master valve 14 closes, bleed off pressure on the tree above the valve, and then open the riser and install the wireline equipment. At this time, the operator may reverse circulate the TFL tool into retained position and raise the reverse circulation pressure to cause the pilot valve to open master valve 14.

From the foregoing it will be seen that this invention is one well adapted to attain all of the ends and objects hereinabove set forth, together with other advantages which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawing is to be interpreted as illustrative and not in a limiting sense.

The invention having been described, what is claimed is:

1. Apparatus for controlling flow from an offshore well, comprising an underwater Christmas tree having a production bore through which TFL tools may be passed to and from the well through a flowline connectible with the bore, an auxiliary bore intersecting the production bore to permit wireline tools to be lowered into or raised from the well, valve means for opening and closing the production bore below the intersection of the auxiliary bore therewith in response to fluid pressure at a location above said intersection being respectively above or below a predetermined value, and means for receiving and releasably retaining a TFL tool intermediate said intersection and said location so that fluid pressure at said location may be maintained above said predetermined value.

2. The apparatus of the character defined in claim 1, wherein said TFL receiving and retaining means comprises a groove for receiving locking dogs on said TFL tool.

3. An underwater Christmas tree for controlling flow from an offshore well, said tree having a production bore through which TFL tools may be passed to and from the well through a flowline connectible with the bore, an auxiliary bore intersecting the production bore to permit wireline tools to be lowered into or raised from the well, means for sensing fluid pressure at a location within the production bore above the intersection of the auxiliary bore therewith, means for receiving and releasably retaining a TFL tool within said production bore in order to limit flow therepast intermediate said intersection and the fluid pressure sensing means, and thereby permit fluid pressure at said location to be maintained above a predetermined value, and means for transmitting a signal representative of the sensed fluid pressure to a remote location for use in opening and closing valve means in the production bore beneath said intersection.

4. An underwater Christmas tree for controlling flow from an offshore well, said tree having a production bore through which TFL tools may be passed to and from the well through a flowline connectible with the bore, said production bore including a lower generally vertical portion connectible with the well and an upper portion which curves upwardly and outwardly from the lower portion for connection with the flowline, a generally vertical auxiliary bore intersecting the production bore to form an upper continuation of the lower portion thereof, whereby wireline tools may be lowered into or raised from the well through said auxiliary bore, and means for receiving and releasably retaining a TFL tool within the upper portion of said production bore in order to limit flow therepast, said last-mentioned means permitting the TFL tool to be pumped from the flowline into but not beyond retained position, and then pumped out of retained position back into the flowline.

5. For use with an underwater Christmas tree having a production bore to which a flowline is fluidly connectible to permit TFL tools to be passed to and from an offshore well, a tubular member adapted to be connected as part of the production bore, the bore of said member having a locking groove thereabout to receive locking dogs on a TFL tool so as to locate and retain the tool therein as the tool is pumped from the flowline into the tubular member, but release the tool therefrom as it is pumped back into the flowline, a sealing surface thereabout spaced longitudinally of the groove in position to be sealably engageable by a seal member about the tool, and means for sensing the pressure of fluid therein on the side of the sealing surface away from the groove and transmitting a signal representative of the sensed fluid pressure to a remote location.

6. An underwater Christmas tree for controlling flow from an offshore well, said tree having a production bore through which TFL tools may be passed to and from the well through a flowline connectible with the bore, an auxiliary bore intersecting the production bore to permit wireline tools to be lowered into or raised from the well, means for sensing fluid pressure at a location within the production bore above the intersection of the auxiliary bore therewith, for receiving and releasably retaining a TFL tool within said production bore in order to limit flow therepast intermediate said intersection and the fluid pressure sensing means, and thereby permit fluid pressure at said location to be maintained above a predetermined value, said TFL receiving and retaining means comprising a groove for receiving locking dogs on said TFL tool.

7. An underwater Christmas tree for controlling flow from an offshore well, said tree having a production bore through which TFL tools may be passed to and from the well through a flowline connectible with the bore, said production bore including a lower generally vertical portion connectible with the well and an upper portion which curves upwardly and outwardly from the lower portion for connection with the flowline, a generally vertical auxiliary bore intersecting the production bore to form an upper continuation of the lower portion thereof, whereby wireline tools may be lowered into or raised from the well through said auxiliary bore, and means for receiving and releasably retaining a TFL tool within the upper portion of said production bore in order to limit flow therepast, said TFL receiving and retaining means comprising a groove for receiving locking dogs on said TFL tool.

* * * * *